US009222267B2

(12) United States Patent
Bergelin et al.

(10) Patent No.: US 9,222,267 B2
(45) Date of Patent: Dec. 29, 2015

(54) SET OF FLOORBOARDS HAVING A RESILIENT GROOVE

(71) Applicant: VALINGE INNOVATION AB, Viken (SE)

(72) Inventors: Marcus Bergelin, Lerberget (SE); Mats Nilsson, Viken (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 13/943,464

(22) Filed: Jul. 16, 2013

(65) Prior Publication Data

US 2013/0298487 A1 Nov. 14, 2013

Related U.S. Application Data

(63) Continuation of application No. 13/552,357, filed on Jul. 18, 2012, now Pat. No. 8,511,031, which is a continuation of application No. 13/046,011, filed on Mar. 11, 2011, now Pat. No. 8,245,478, which is a (Continued)

(30) Foreign Application Priority Data

Jan. 12, 2006 (SE) ..... 0600055

(51) Int. Cl.
*E04F 15/16* (2006.01)
*E04F 15/02* (2006.01)
*E04F 15/18* (2006.01)

(52) U.S. Cl.
CPC ..... *E04F 15/02* (2013.01); *E04F 15/02016* (2013.01); *E04F 15/02033* (2013.01);

(Continued)

(58) Field of Classification Search
CPC ..... E04F 15/02016; E04F 15/02033; E04F 15/02161
USPC ..... 52/311.1, 314, 316, 390, 578, 588.1, 52/591.3, 592.1; 428/50, 192
See application file for complete search history.

(56) References Cited

U.S. PATENT DOCUMENTS 213,740 A 4/1879 Connor
1,018,987 A 2/1912 Philpot et al.

(Continued)

FOREIGN PATENT DOCUMENTS

CA 1 237 344 5/1988
CA 2 252 791 A1 5/1999

(Continued)

OTHER PUBLICATIONS

International Search Report issued in PCT/SE2007/000007, Mar. 21, 2007, Swedish Patent Office, Stockholm, SE, 5 pages.

(Continued)

*Primary Examiner* — Robert Canfield
(74) *Attorney, Agent, or Firm* — Buchanan Ingersoll & Rooney P.C.

(57) ABSTRACT

A set of essentially identical floorboards each including a front face and a rear face extending in the horizontal plane, a core, and a surface layer, a mechanical locking system is arranged at least at two opposite edges for connecting a floorboard with an adjacent floorboard in a horizontal and a vertical direction, said mechanical locking system being configured for connecting the floorboard with the adjacent floorboard by vertical folding, wherein one of said opposite edges is provided with a horizontally extending protrusion at an upper edge, and wherein said protrusion is configured to overlap a surface groove at an upper edge of the other of said opposite edges, such that two connected and adjacent floorboards have upper overlapping edges.

24 Claims, 6 Drawing Sheets

Related U.S. Application Data continuation of application No. 11/649,837, filed on Jan. 5, 2007, now Pat. No. 7,930,862.

(60) Provisional application No. 60/758,213, filed on Jan. 12, 2006.

(52) U.S. Cl.
CPC ..... *E04F15/02161* (2013.01); *E04F 15/181* (2013.01); *E04F 15/02038* (2013.01); *E04F 2201/0115* (2013.01); *E04F 2201/0153* (2013.01); *E04F 2201/026* (2013.01); *E04F 2201/0523* (2013.01); *E04F 2290/042* (2013.01); *Y10T 428/167* (2015.01); *Y10T 428/24777* (2015.01)

(56) References Cited

U.S. PATENT DOCUMENTS

| | | | | |
|---|---|---|---|---|
| 1,361,501 | A | | 12/1920 | Schepmoes |
| 1,394,120 | A | | 10/1921 | Rockwell |
| 1,723,306 | A | | 8/1929 | Sipe |
| 1,743,492 | A | | 1/1930 | Sipe |
| 1,787,027 | A | | 12/1930 | Wasleff |
| 1,925,070 | A | | 8/1933 | Livezey |
| 1,946,646 | A | | 2/1934 | Storm |
| 1,946,690 | A | | 2/1934 | Haines |
| 2,015,813 | A | | 10/1935 | Nielsen |
| 2,088,238 | A | | 7/1937 | Greenway |
| 2,089,075 | A | | 8/1937 | Siebs |
| 2,142,305 | A | | 1/1939 | Davis |
| 2,204,675 | A | | 6/1940 | Grunert |
| 2,266,464 | A | | 12/1941 | Kraft |
| 2,303,745 | A | | 12/1942 | Karreman |
| 2,306,295 | A | | 12/1942 | Casto |
| 2,355,834 | A | | 8/1944 | Webb |
| 2,497,837 | A | | 2/1950 | Nelson |
| 2,740,167 | A | | 4/1956 | Rowley |
| 2,769,726 | A | | 11/1956 | Wetterau et al. |
| 2,818,895 | A | | 1/1958 | Zuber |
| 2,872,712 | A | | 2/1959 | Brown |
| 2,947,040 | A | | 8/1960 | Schultz |
| 3,055,461 | A | | 9/1962 | De Ridder |
| 3,087,269 | A | * | 4/1963 | Hudson ..... 428/171 |
| 3,120,083 | A | | 2/1964 | Dahlberg et al. |
| 3,247,638 | A | | 4/1966 | Gay et al. |
| 3,259,417 | A | | 7/1966 | Chapman |
| 3,310,919 | A | | 3/1967 | Bue et al. |
| 3,397,496 | A | | 8/1968 | Sohns |
| 3,436,888 | A | | 4/1969 | Ottosson |
| 3,538,665 | A | | 11/1970 | Gohner |
| 3,554,850 | A | | 1/1971 | Kuhle |
| 3,578,548 | A | | 5/1971 | Wesp |
| 3,619,963 | A | | 11/1971 | Omholt |
| 3,623,288 | A | | 11/1971 | Horowitz |
| 3,657,852 | A | | 4/1972 | Worthington et al. |
| 3,694,983 | A | | 10/1972 | Couquet |
| 3,760,547 | A | | 9/1973 | Brenneman |
| 3,857,749 | A | | 12/1974 | Yoshida |
| 3,883,258 | A | | 5/1975 | Hewson |
| 3,937,861 | A | | 2/1976 | Zuckerman et al. |
| 3,946,529 | A | | 3/1976 | Chevaux |
| 3,950,915 | A | | 4/1976 | Cole |
| 4,023,596 | A | | 5/1977 | Tate |
| 4,037,377 | A | | 7/1977 | Howell et al. |
| 4,100,710 | A | | 7/1978 | Kowallik |
| 4,169,688 | A | | 10/1979 | Toshio |
| 4,170,859 | A | | 10/1979 | Counihan |
| 4,176,210 | A | | 11/1979 | Skinner |
| 4,226,064 | A | | 10/1980 | Kraayenhof |
| 4,242,390 | A | | 12/1980 | Nemeth |
| 4,296,017 | A | | 10/1981 | Weissgerber et al. |
| 4,299,070 | A | | 11/1981 | Oltmanns et al. |
| 4,312,686 | A | | 1/1982 | Smith et al. |
| 4,315,724 | A | | 2/1982 | Taoka et al. |
| 4,426,820 | A | | 1/1984 | Terbrack et al. |
| 4,454,699 | A | | 6/1984 | Strobl |
| 4,489,115 | A | | 12/1984 | Layman et al. |
| 4,512,131 | A | | 4/1985 | Laramore |
| 4,526,418 | A | | 7/1985 | Martin |
| 4,570,353 | A | | 2/1986 | Evans |
| 4,574,099 | A | | 3/1986 | Nixon |
| 4,599,841 | A | | 7/1986 | Haid |
| 4,610,900 | A | | 9/1986 | Nishibori |
| 4,724,187 | A | | 2/1988 | Ungar et al. |
| 4,759,164 | A | | 7/1988 | Abendroth et al. |
| 4,769,963 | A | | 9/1988 | Meyerson |
| 4,788,088 | A | | 11/1988 | Kohl |
| 4,807,412 | A | | 2/1989 | Frederiksen |
| 4,849,768 | A | | 7/1989 | Graham |
| 4,944,514 | A | | 7/1990 | Suiter |
| 4,947,595 | A | | 8/1990 | Douds et al. |
| 4,976,221 | A | | 12/1990 | Yetter |
| 5,007,222 | A | | 4/1991 | Raymond |
| 5,050,362 | A | | 9/1991 | Tal et al. |
| 5,052,158 | A | | 10/1991 | D'Luzansky |
| 5,076,034 | A | | 12/1991 | Bandy |
| 5,112,671 | A | | 5/1992 | Diamond et al. |
| 5,134,026 | A | | 7/1992 | Melcher |
| 5,162,141 | A | | 11/1992 | Davey et al. |
| 5,185,193 | A | | 2/1993 | Phenicie et al. |
| 5,229,217 | A | | 7/1993 | Holzer |
| 5,295,341 | A | | 3/1994 | Kajiwara |
| 5,322,335 | A | | 6/1994 | Niemi |
| 5,333,429 | A | | 8/1994 | Cretti |
| 5,349,796 | A | | 9/1994 | Meyerson |
| 5,367,844 | A | | 11/1994 | Diedrich |
| 5,433,806 | A | | 7/1995 | Pasquali et al. |
| 5,480,602 | A | | 1/1996 | Nagaich |
| 5,502,939 | A | | 4/1996 | Zadok |
| 5,503,788 | A | | 4/1996 | Lazareck et al. |
| 5,516,472 | A | | 5/1996 | Laver |
| 5,553,427 | A | | 9/1996 | Andres |
| 5,613,339 | A | | 3/1997 | Pollock |
| 5,618,602 | A | | 4/1997 | Nelson |
| 5,642,592 | A | | 7/1997 | Andres |
| 5,647,184 | A | | 7/1997 | Davis |
| 5,653,099 | A | | 8/1997 | MacKenzie |
| 5,660,016 | A | | 8/1997 | Erwin et al. |
| 5,662,977 | A | | 9/1997 | Spain et al. |
| 5,670,237 | A | | 9/1997 | Shultz et al. |
| 5,671,575 | A | | 9/1997 | Wu |
| 5,694,730 | A | | 12/1997 | Del Rincon et al. |
| 5,706,621 | A | | 1/1998 | Pervan |
| 5,713,165 | A | | 2/1998 | Erwin |
| 5,724,909 | A | | 3/1998 | Pitman et al. |
| 5,728,476 | A | | 3/1998 | Harwood |
| 5,755,068 | A | | 5/1998 | Ormiston |
| 5,758,466 | A | | 6/1998 | Tucker |
| 5,777,014 | A | | 7/1998 | Hopper et al. |
| 5,780,147 | A | | 7/1998 | Sugahara et al. |
| 5,791,113 | A | | 8/1998 | Glowa et al. |
| 5,797,237 | A | | 8/1998 | Finkell, Jr. |
| 5,833,386 | A | | 11/1998 | Rosan et al. |
| 5,836,128 | A | | 11/1998 | Groh et al. |
| 5,856,389 | A | | 1/1999 | Kostrzewski et al. |
| 5,858,160 | A | | 1/1999 | Piacente |
| 5,863,632 | A | | 1/1999 | Bisker |
| 5,869,138 | A | | 2/1999 | Nishibori |
| D406,360 | S | | 3/1999 | Finkell, Jr. |
| 5,900,099 | A | | 5/1999 | Sweet |
| 5,989,668 | A | | 11/1999 | Nelson et al. |
| 6,004,417 | A | | 12/1999 | Roesch et al. |
| 6,006,486 | A | | 12/1999 | Moriau |
| 6,023,907 | A | | 2/2000 | Pervan |
| 6,027,599 | A | | 2/2000 | Wang |
| 6,029,416 | A | | 2/2000 | Andersson |
| 6,093,473 | A | | 7/2000 | Min |
| 6,101,778 | A | | 8/2000 | Martensson |
| 6,139,945 | A | | 10/2000 | Krejchi et al. |
| 6,173,548 | B1 | | 1/2001 | Hamar et al. |
| 6,189,282 | B1 | | 2/2001 | VanderWerf |
| 6,233,899 | B1 | | 5/2001 | Mellert et al. |
| 6,260,326 | B1 | | 7/2001 | Muller-Hartburg |
| 6,314,701 | B1 | | 11/2001 | Meyerson |

(56) References Cited

U.S. PATENT DOCUMENTS 6,324,809 B1 12/2001 Nelson
6,332,733 B1 12/2001 Hamberger et al.
6,345,481 B1 2/2002 Nelson
6,363,677 B1 4/2002 Chen
6,397,547 B1 6/2002 Martensson
6,438,919 B1 8/2002 Knauseder
6,455,127 B1 9/2002 Valtanen
6,460,306 B1 10/2002 Nelson
6,505,452 B1 1/2003 Hannig
6,536,178 B1 3/2003 Palsson et al.
6,546,691 B2 4/2003 Leopolder
6,558,070 B1 5/2003 Valtanen
6,591,568 B1 7/2003 Palsson et al.
6,617,009 B1 9/2003 Chen et al.
6,647,690 B1 11/2003 Martensson
6,671,968 B2 1/2004 Shannon
6,672,030 B2 1/2004 Schulte
6,675,545 B2 1/2004 Chen et al.
6,695,944 B2 2/2004 Courtney
6,711,869 B2 3/2004 Tychsen
6,715,253 B2 4/2004 Pervan
6,729,091 B1 5/2004 Martensson
6,761,008 B2 7/2004 Chen et al.
6,766,622 B1 7/2004 Thiers
6,769,218 B2 8/2004 Pervan
6,769,219 B2 8/2004 Schwitte et al.
6,786,019 B2 9/2004 Thiers
6,804,926 B1 10/2004 Eisermann
6,835,421 B1 12/2004 Dohring
6,851,237 B2 2/2005 Niese et al.
6,854,235 B2 2/2005 Martensson
6,862,857 B2 3/2005 Tychsen
6,874,292 B2 4/2005 Moriau
6,880,305 B2 4/2005 Pervan et al.
6,880,307 B2 4/2005 Schwitte
6,895,881 B1 5/2005 Whitaker
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,933,043 B1 8/2005 Son et al.
6,955,020 B2 10/2005 Moriau et al.
6,966,963 B2 11/2005 O'Connor
6,986,934 B2 1/2006 Chen et al.
7,051,486 B2 5/2006 Pervan
7,086,205 B2 8/2006 Pervan
7,090,430 B1 8/2006 Fletcher
D528,671 S 9/2006 Grafenauer
7,121,058 B2 10/2006 Palsson et al.
7,127,860 B2 10/2006 Pervan et al.
7,137,229 B2 11/2006 Pervan
7,169,460 B1 1/2007 Chen et al.
7,171,791 B2 2/2007 Pervan
7,211,310 B2 5/2007 Chen et al
7,275,350 B2 10/2007 Pervan et al.
7,328,536 B2 2/2008 Moriau et al.
7,337,588 B1 3/2008 Moebus
7,356,971 B2 4/2008 Pervan
7,386,963 B2 6/2008 Pervan
7,398,625 B2 7/2008 Pervan
7,419,717 B2 9/2008 Chen et al.
7,454,875 B2 11/2008 Pervan et al.
7,516,588 B2 * 4/2009 Pervan ..... 52/592.1
7,543,418 B2 6/2009 Weitzer
7,568,322 B2 8/2009 Pervan et al.
7,584,583 B2 9/2009 Bergelin et al.
7,603,826 B1 10/2009 Moebus
7,739,849 B2 6/2010 Pervan
7,763,345 B2 7/2010 Chen et al.
7,779,597 B2 8/2010 Thiers et al.
7,802,415 B2 9/2010 Pervan
7,856,784 B2 12/2010 Martensson
7,856,789 B2 12/2010 Eisermann
7,866,115 B2 * 1/2011 Pervan et al. ..... 52/745.19
7,886,497 B2 2/2011 Pervan et al.
7,896,571 B1 3/2011 Hannig et al.
7,926,234 B2 * 4/2011 Pervan et al. ..... 52/390
7,930,862 B2 4/2011 Bergelin et al.
7,980,043 B2 7/2011 Moebus
8,021,741 B2 9/2011 Chen et al.
8,028,486 B2 10/2011 Pervan
8,112,891 B2 2/2012 Pervan
8,234,829 B2 8/2012 Thiers et al.
8,245,478 B2 8/2012 Bergelin et al.
8,293,058 B2 10/2012 Pervan et al.
8,356,452 B2 1/2013 Thiers et al.
8,365,499 B2 2/2013 Nilsson et al.
8,490,361 B2 7/2013 Curry et al.
8,511,031 B2 8/2013 Bergelin et al.
8,584,423 B2 11/2013 Pervan et al.
8,613,826 B2 12/2013 Pervan et al.
8,658,274 B2 2/2014 Chen et al.
8,683,698 B2 * 4/2014 Pervan et al. ..... 29/897.32
8,756,899 B2 6/2014 Nilsson et al.
8,800,150 B2 8/2014 Pervan
8,834,992 B2 9/2014 Chen et al.
2001/0021431 A1 9/2001 Chen
2001/0036557 A1 11/2001 Ingrim et al.
2002/0007608 A1 1/2002 Pervan
2002/0007609 A1 1/2002 Pervan
2002/0031646 A1 3/2002 Chen
2002/0046433 A1 4/2002 Sellman et al.
2002/0056245 A1 5/2002 Thiers
2002/0083673 A1 7/2002 Kettler et al.
2002/0092263 A1 7/2002 Schulte
2002/0095894 A1 7/2002 Pervan
2002/0100231 A1 8/2002 Miller et al.
2002/0112429 A1 8/2002 Niese et al.
2002/0112433 A1 8/2002 Pervan
2002/0142135 A1 10/2002 Chen et al.
2002/0170257 A1 11/2002 McLain et al.
2002/0170258 A1 11/2002 Schwitte et al.
2002/0178674 A1 12/2002 Pervan
2002/0178681 A1 12/2002 Zancai
2002/0189183 A1 12/2002 Ricciardelli
2003/0009971 A1 1/2003 Palmberg
2003/0024199 A1 2/2003 Pervan
2003/0024200 A1 2/2003 Moriau et al.
2003/0033777 A1 2/2003 Thiers et al.
2003/0101674 A1 6/2003 Pervan et al.
2003/0101681 A1 6/2003 Tychsen
2003/0154676 A1 8/2003 Schwartz
2003/0196397 A1 10/2003 Niese et al.
2003/0196405 A1 10/2003 Pervan
2004/0003888 A1 1/2004 Mott et al.
2004/0031227 A1 2/2004 Knauseder
2004/0035078 A1 * 2/2004 Pervan ..... 52/589.1
2004/0068954 A1 4/2004 Martensson
2004/0107659 A1 6/2004 Glockl
2004/0139678 A1 7/2004 Pervan
2004/0177584 A1 9/2004 Pervan
2004/0182036 A1 9/2004 Sjöberg et al.
2004/0206036 A1 10/2004 Pervan
2004/0211144 A1 10/2004 Stanchfield
2004/0255538 A1 12/2004 Ruhdorfer
2004/0255541 A1 12/2004 Thiers et al.
2005/0003160 A1 1/2005 Chen et al.
2005/0055943 A1 3/2005 Pervan
2005/0138881 A1 6/2005 Pervan
2005/0166502 A1 8/2005 Pervan
2005/0166516 A1 8/2005 Pervan
2005/0193677 A1 9/2005 Vogel
2005/0208255 A1 9/2005 Pervan
2005/0210810 A1 9/2005 Pervan
2005/0268570 A2 12/2005 Pervan
2006/0032168 A1 2/2006 Thiers
2006/0048474 A1 * 3/2006 Pervan et al. ..... 52/589.1
2006/0075713 A1 4/2006 Pervan et al.
2006/0099386 A1 5/2006 Smith
2006/0101769 A1 5/2006 Pervan et al.
2006/0144004 A1 7/2006 Nollet et al.
2006/0156666 A1 7/2006 Caufield
2006/0196139 A1 9/2006 Pervan

(56) References Cited

U.S. PATENT DOCUMENTS

| | | | | |
|---|---|---|---|---|
| 2006/0283127 | A1 | 12/2006 | Pervan | |
| 2007/0011981 | A1 | 1/2007 | Eisermann | |
| 2007/0028547 | A1 | 2/2007 | Grafenauer et al. | |
| 2007/0166516 | A1 | 7/2007 | Kim et al. | |
| 2007/0175143 | A1 | 8/2007 | Pervan et al. | |
| 2007/0175144 | A1 | 8/2007 | Hakansson | |
| 2007/0175148 | A1* | 8/2007 | Bergelin et al. | 52/480 |
| 2007/0175156 | A1 | 8/2007 | Pervan et al. | |
| 2007/0196624 | A1 | 8/2007 | Chen et al. | |
| 2008/0000179 | A1 | 1/2008 | Pervan | |
| 2008/0000180 | A1 | 1/2008 | Pervan | |
| 2008/0000182 | A1 | 1/2008 | Pervan | |
| 2008/0000183 | A1* | 1/2008 | Bergelin et al. | 52/480 |
| 2008/0000186 | A1 | 1/2008 | Pervan | |
| 2008/0000187 | A1 | 1/2008 | Pervan | |
| 2008/0000188 | A1 | 1/2008 | Pervan | |
| 2008/0000189 | A1 | 1/2008 | Pervan et al. | |
| 2008/0000194 | A1 | 1/2008 | Pervan | |
| 2008/0000417 | A1 | 1/2008 | Pervan et al. | |
| 2008/0005989 | A1 | 1/2008 | Pervan et al. | |
| 2008/0005992 | A1 | 1/2008 | Pervan | |
| 2008/0005997 | A1 | 1/2008 | Pervan | |
| 2008/0005998 | A1 | 1/2008 | Pervan | |
| 2008/0005999 | A1 | 1/2008 | Pervan | |
| 2008/0008871 | A1 | 1/2008 | Pervan | |
| 2008/0010931 | A1 | 1/2008 | Pervan | |
| 2008/0010937 | A1 | 1/2008 | Pervan | |
| 2008/0028707 | A1 | 2/2008 | Pervan | |
| 2008/0028713 | A1 | 2/2008 | Pervan | |
| 2008/0029490 | A1 | 2/2008 | Martin et al. | |
| 2008/0034701 | A1 | 2/2008 | Pervan | |
| 2008/0034708 | A1 | 2/2008 | Pervan | |
| 2008/0041007 | A1 | 2/2008 | Pervan et al. | |
| 2008/0041008 | A1 | 2/2008 | Pervan | |
| 2008/0060308 | A1 | 3/2008 | Pervan | |
| 2008/0066415 | A1 | 3/2008 | Pervan et al. | |
| 2008/0104921 | A1 | 5/2008 | Pervan et al. | |
| 2008/0110125 | A1 | 5/2008 | Pervan | |
| 2008/0134607 | A1 | 6/2008 | Pervan et al. | |
| 2008/0134613 | A1 | 6/2008 | Pervan | |
| 2008/0134614 | A1 | 6/2008 | Pervan et al. | |
| 2008/0138560 | A1 | 6/2008 | Windmoller | |
| 2008/0172971 | A1* | 7/2008 | Pervan | 52/591.5 |
| 2008/0241440 | A1 | 10/2008 | Bauer | |
| 2008/0256890 | A1 | 10/2008 | Pervan | |
| 2008/0263975 | A1 | 10/2008 | Mead | |
| 2008/0311355 | A1 | 12/2008 | Chen et al. | |
| 2009/0049787 | A1 | 2/2009 | Hannig | |
| 2009/0133353 | A1 | 5/2009 | Pervan et al. | |
| 2009/0155612 | A1 | 6/2009 | Pervan et al. | |
| 2009/0193748 | A1 | 8/2009 | Boo et al. | |
| 2009/0249733 | A1 | 10/2009 | Moebus | |
| 2010/0242398 | A1 | 9/2010 | Cullen | |
| 2010/0260962 | A1 | 10/2010 | Chen et al. | |
| 2010/0300030 | A1 | 12/2010 | Pervan et al. | |
| 2011/0030303 | A1 | 2/2011 | Pervan et al. | |
| 2011/0041996 | A1 | 2/2011 | Pervan | |
| 2011/0056167 | A1 | 3/2011 | Nilsson et al. | |
| 2011/0131901 | A1 | 6/2011 | Pervan | |
| 2011/0154763 | A1 | 6/2011 | Bergelin et al. | |
| 2012/0003439 | A1 | 1/2012 | Chen et al. | |
| 2012/0040149 | A1 | 2/2012 | Chen et al. | |
| 2012/0137617 | A1 | 6/2012 | Pervan | |
| 2012/0216472 | A1 | 8/2012 | Martensson | |
| 2012/0279154 | A1 | 11/2012 | Bergelin et al. | |
| 2013/0014890 | A1 | 1/2013 | Pervan et al. | |
| 2013/0047536 | A1 | 2/2013 | Pervan | |
| 2013/0111758 | A1 | 5/2013 | Nilsson et al. | |
| 2013/0160391 | A1 | 6/2013 | Pervan | |
| 2013/0298487 | A1* | 11/2013 | Bergelin et al. | 52/309.1 |
| 2013/0305649 | A1* | 11/2013 | Thiers | 52/588.1 |
| 2014/0033635 | A1 | 2/2014 | Pervan et al. | |
| 2014/0069044 | A1* | 3/2014 | Wallin | 52/588.1 |
| 2014/0115994 | A1 | 5/2014 | Pervan | |
| 2014/0237924 | A1 | 8/2014 | Nilsson et al. | |
| 2014/0283466 | A1 | 9/2014 | Boo | |
| 2014/0318061 | A1 | 10/2014 | Pervan | |
| 2014/0356594 | A1 | 12/2014 | Chen et al. | |

FOREIGN PATENT DOCUMENTS

| | | | | |
|---|---|---|---|---|
| CA | 2 252 791 | C | 5/2004 | |
| CN | 2076142 | U | 5/1991 | |
| CN | 2106197 | U | 6/1992 | |
| CN | 2124276 | U | 12/1992 | |
| CN | 2272915 | | 1/1998 | |
| CN | 2301491 | | 12/1998 | |
| CN | 1270263 | A | 10/2000 | |
| DE | 1 081 653 | | 5/1960 | |
| DE | 1 534 802 | | 4/1970 | |
| DE | 28 24 656 | A1 | 1/1979 | |
| DE | 134 967 | | 4/1979 | |
| DE | 2832817 | A1 * | 2/1980 | |
| DE | 31 50 352 | A1 | 10/1982 | |
| DE | 31 35 716 | A1 | 6/1983 | |
| DE | 33 43 601 | A1 | 12/1983 | |
| DE | 35 38 538 | A1 | 5/1987 | |
| DE | 3904686 | C1 * | 8/1989 | B24B 19/03 |
| DE | 39 32 980 | A1 | 11/1991 | |
| DE | 40 20 682 | A1 | 1/1992 | |
| DE | 42 42 530 | A1 | 6/1994 | |
| DE | 295 17 995 | U1 | 3/1996 | |
| DE | 198 54 475 | A1 | 7/1999 | |
| DE | 299 08 733 | U1 | 8/1999 | |
| DE | 298 23 681 | U1 | 12/1999 | |
| DE | 200 02 744 | U1 | 9/2000 | |
| DE | 200 08 708 | U1 | 9/2000 | |
| DE | 200 18 817 | U1 | 2/2001 | |
| DE | 199 44 399 | A1 | 4/2001 | |
| DE | 100 01 248 | A1 | 7/2001 | |
| DE | 100 32 204 | C1 | 7/2001 | |
| DE | 100 06 748 | A1 | 8/2001 | |
| DE | 202 06 460 | U1 | 8/2002 | |
| DE | 202 07 844 | U | 8/2002 | |
| DE | 202 14 532 | U1 | 3/2004 | |
| DE | 103 16 695 | A1 | 10/2004 | |
| DE | 103 16 886 | A1 | 10/2004 | |
| DE | 20 2004 014 160 | U1 | 12/2004 | |
| DE | 10 2004 011 531 | B3 | 11/2005 | |
| DE | 198 54 475 | B4 | 6/2006 | |
| DE | 10 2005 023 661 | A1 | 11/2006 | |
| EP | 0 046 526 | A2 | 3/1982 | |
| EP | 0 562 402 | A1 | 9/1993 | |
| EP | 0 665 347 | A1 | 8/1995 | |
| EP | 0 698 126 | A1 | 2/1996 | |
| EP | 0 843 763 | A1 | 5/1998 | |
| EP | 0 890 373 | A1 | 1/1999 | |
| EP | 0 903 451 | A2 | 3/1999 | |
| EP | 0 903 451 | A3 | 8/1999 | |
| EP | 1 024 234 | A2 | 8/2000 | |
| EP | 1 036 341 | A | 9/2000 | |
| EP | 0 843 763 | B1 | 10/2000 | |
| EP | 1 045 083 | A1 | 10/2000 | |
| EP | 1 061 201 | A2 | 12/2000 | |
| EP | 1 165 906 | | 1/2002 | |
| EP | 1 165 906 | B1 | 8/2002 | |
| EP | 1 045 083 | B1 | 10/2002 | |
| EP | 1 262 607 | A1 | 12/2002 | |
| EP | 1 262 609 | A1 | 12/2002 | |
| EP | 1 357 239 | A2 | 10/2003 | |
| EP | 1 362 947 | A2 | 11/2003 | |
| EP | 0 890 373 | B1 | 2/2004 | |
| EP | 1 357 239 | A3 | 7/2004 | |
| EP | 1 036 341 | B1 | 2/2005 | |
| EP | 2 189 591 | A3 * | 5/2010 | |
| FR | 1 293 043 | A | 5/1962 | |
| FR | 2 278 876 | A1 | 2/1976 | |
| FR | 2 445 875 | A1 | 1/1980 | |
| FR | 2 498 666 | A1 | 7/1982 | |
| FR | 2 557 905 | | 7/1985 | |
| FR | 2 810 060 | A1 | 12/2001 | |
| GB | 25 180 | | 0/1907 | |
| GB | 484 750 | | 5/1938 | |
| GB | 875 327 | | 8/1961 | |

(56) References Cited

FOREIGN PATENT DOCUMENTS

| | | | | |
|---|---|---|---|---|
| GB | 900 958 | | | 7/1962 |
| GB | 1 189 185 | | | 4/1970 |
| GB | 1 308 011 | | | 2/1973 |
| GB | 1 430 423 | | | 3/1976 |
| GB | 1 430 423 | A | | 3/1976 |
| GB | 1 520 964 | A | | 8/1978 |
| GB | 2 020 998 | A | | 11/1979 |
| GB | 2 095 814 | A | | 10/1982 |
| GB | 2 117 813 | A | | 10/1983 |
| GB | 2 145 371 | A | | 3/1985 |
| GB | 2 147 856 | A | | 5/1985 |
| GB | 2 243 381 | A | | 10/1991 |
| GB | 2 256 023 | A | | 11/1992 |
| JP | 56-104936 | U | | 1/1981 |
| JP | 56-131752 | A | | 10/1981 |
| JP | 57-119056 | | | 7/1982 |
| JP | 57-157636 | U | | 10/1982 |
| JP | 59-185346 | U | | 12/1984 |
| JP | 60-255843 | A | | 12/1985 |
| JP | 62-127225 | | | 6/1987 |
| JP | 1-178659 | A | | 7/1989 |
| JP | 1-202403 | | * | 8/1989 |
| JP | 1-33702 | Y2 | | 10/1989 |
| JP | 3-169967 | | | 7/1991 |
| JP | H05-169534 | A | | 7/1993 |
| JP | 5-96282 | U | | 12/1993 |
| JP | 05-318674 | A | | 12/1993 |
| JP | 06-064108 | | | 3/1994 |
| JP | 6-39840 | B2 | | 5/1994 |
| JP | 06-315944 | | | 11/1994 |
| JP | 7-26467 | U | | 5/1995 |
| JP | 7-180333 | A | | 7/1995 |
| JP | 8-086080 | A | | 4/1996 |
| JP | 8-109734 | A | | 4/1996 |
| JP | 9-053319 | A | | 2/1997 |
| JP | 09-254697 | | | 9/1997 |
| JP | 10-002096 | A | | 1/1998 |
| JP | 10-219975 | A | | 8/1998 |
| JP | 11-131771 | A | | 5/1999 |
| JP | 11-268010 | A | | 10/1999 |
| JP | 2002-011708 | A | | 1/2002 |
| JP | 3363976 | B2 | | 1/2003 |
| KR | 1996-0005785 | | | 7/1996 |
| KR | 2007/0000322 | A | | 1/2007 |
| SE | 506 254 | C2 | | 11/1997 |
| SE | 0000785 | A | | 9/2001 |
| SE | 0103130 | A | | 3/2003 |
| WO | WO 89/03753 | A1 | | 5/1989 |
| WO | WO 90/06232 | A1 | | 6/1990 |
| WO | WO 94/01628 | A2 | | 1/1994 |
| WO | WO 94/26999 | A1 | | 11/1994 |
| WO | WO 94/28183 | | | 12/1994 |
| WO | WO 95/11333 | | | 4/1995 |
| WO | WO 96/07801 | A1 | | 3/1996 |
| WO | WO 96/09262 | A1 | | 3/1996 |
| WO | WO 96/27721 | A1 | | 9/1996 |
| WO | WO 97/10396 | | | 3/1997 |
| WO | WO 97/18949 | A1 | | 5/1997 |
| WO | WO 97/21011 | | | 6/1997 |
| WO | WO 97/47834 | A1 | | 12/1997 |
| WO | WO 98/24995 | A1 | | 6/1998 |
| WO | WO 98/38401 | A1 | | 9/1998 |
| WO | WO 98/58142 | A1 | | 12/1998 |
| WO | WO 99/17930 | A1 | | 4/1999 |
| WO | WO 99/58254 | A1 | | 11/1999 |
| WO | WO 99/66151 | A1 | | 12/1999 |
| WO | WO 99/66152 | A1 | | 12/1999 |
| WO | WO 00/17467 | A1 | | 3/2000 |
| WO | WO 00/22225 | A1 | | 4/2000 |
| WO | WO 00/44984 | A1 | | 8/2000 |
| WO | WO 00/47841 | A1 | | 8/2000 |
| WO | WO 00/66856 | A1 | | 11/2000 |
| WO | WO 01/02669 | A1 | | 1/2001 |
| WO | WO 01/02670 | A1 | | 1/2001 |
| WO | WO 01/02671 | A1 | | 1/2001 |
| WO | WO 01/47726 | A1 | | 7/2001 |
| WO | WO 01/48331 | A1 | | 7/2001 |
| WO | WO 01/48332 | A1 | | 7/2001 |
| WO | WO 01/48333 | A1 | | 7/2001 |
| WO | WO 01/51732 | A1 | | 7/2001 |
| WO | WO 01/51733 | A1 | | 7/2001 |
| WO | WO 01/53628 | A1 | | 7/2001 |
| WO | WO 01/66877 | A1 | | 9/2001 |
| WO | WO 01/75247 | A1 | | 10/2001 |
| WO | WO 01/77461 | A1 | | 10/2001 |
| WO | WO 01/88306 | A1 | | 11/2001 |
| WO | WO 02/055809 | A1 | | 7/2002 |
| WO | WO 02/055810 | A1 | | 7/2002 |
| WO | WO 02/060691 | A1 | | 8/2002 |
| WO | WO 02/092342 | A1 | | 11/2002 |
| WO | WO 03/012224 | A1 | | 2/2003 |
| WO | WO 03/025307 | A1 | | 3/2003 |
| WO | WO 03/035396 | A1 | | 5/2003 |
| WO | WO 03/078761 | A1 | | 9/2003 |
| WO | WO 03/083234 | A1 | | 10/2003 |
| WO | WO 03/089736 | A1 | | 10/2003 |
| WO | WO 2004/005648 | A1 | | 1/2004 |
| WO | WO 2004/053257 | A1 | | 6/2004 |
| WO | WO 2004/085765 | A1 | | 10/2004 |
| WO | WO 2004/052357 | A8 | | 11/2004 |
| WO | WO 2005/068747 | A1 | | 7/2005 |
| WO | WO 2006/043893 | A1 | | 4/2006 |
| WO | WO 2006/133690 | A1 | | 12/2006 |
| WO | WO 2007/015669 | A2 | | 2/2007 |
| WO | WO 2007/015669 | A3 | | 2/2007 |
| WO | WO 2007/020088 | A1 | | 2/2007 |
| WO | 2007/081267 | A1 | * | 7/2007 |
| WO | WO 2008/008824 | A1 | | 1/2008 |

OTHER PUBLICATIONS

Boo, Christian, U.S. Appl. No. 14/224,628, entitled "Floorboards Provided with a Mechanical Locking System", filed in the U.S. Patent and Trademark Office on Mar. 25, 2014.

Pervan, Darko, et al. U.S. Appl. No. 14/080,973 entitled "Floorboard System and Method for Forming a Flooring, and a Flooring Formed Thereof," filed in the U.S. Patent and Trademark Office on Nov. 15, 2013.

Pervan, Darko, et al. U.S. Appl. No. 14/050,597 entitled "Floor Panel With Sealing Means," filed in the U.S. Patent and Trademark Office on Oct. 10, 2013.

Nilsson, Mats, et al., U.S. Appl. No. 14/272,895 entitled "Resilient Floor," filed in the U.S. Patent and Trademark Office on May 8, 2014.

U.S. Appl. No. 14/324,677, Pervan.

Pervan, Darko, U.S. Appl. No. 14/324,677 entitled "Floorboard and Method for Manufacturing Thereof," filed in the U.S. Patent and Trademark Office on Jul. 7, 2014.

Composite Panel Report: *Laminate Flooring*, *Wood Digest*, Sep. 1999; p. 37, Cygnus Publishing, Inc., & Affiliates, Fort Atkinson, WI, 6 pages.

U.S. Appl. No. 14/693,232, Chen et al.

European Search Report in EP 1 108 529, Apr. 17, 2002 (Mar. 6, 2002), The Hague, NL, 3 pages.

Official Communication from European Patent Office for EP 00 127 179.0 dated Mar. 21, 2007, 4 pages.

Wilkes, et al.., "Table 5.3 Typical properties of General Purpose Vinyl Plastic Products," PVC Handbook, ISBN 3-446-22714-8, 1988, p. 184.

Notice of Opposition to a European Patent dated Feb. 29, 2012, filed with the European Patent Office in related European Patent No. 1108529 (EP Patent Application No. 00127179.0) (23 pages).

Notice of Opposition to a European Patent dated Nov. 6, 2013, filed with the European Patent Office in related European Patent No. 2248665 (EP Patent Application No. 10007691.8) (22 pages).

Communication from European Patent Office dated Oct. 29, 2013 with Letter from Opponent dated Oct. 24, 2013 in related European Patent No. 1108529 (EP Patent Application No. 00127179.0) (11 pages).

Larninatfuβböden, Technik und Technologien, Laminatforum, 1999, pp. 23-24 (4 pages).

(56) References Cited

OTHER PUBLICATIONS

Mobil oil/Holzwerkstoff-Symposium, Stuttgart 1998, Volker Kettler, Witex AG, pp. 1-24.

Ullmann's Encyclopedia of Industrial Chemistry, 1996, vol. A28, pp. 345-350 (9 pages).

Holzwerkstoffe, Herstellung und Verarbeitung: Platten, Beschichtungsstoffe, Formteile, Türen, Möbel; Von Hansgert Soiné: DRW-Verlag, 1995 (51 pages).

Excerpt from Bodenwanddecke, "USA: Das sind die Trends," Apr. 2000, p. 7.

Summons to attend oral proceedings pursuant to Rule 115(1) EPC from European Patent Office dated Nov. 5, 2013 in related European patent No. 1108529 (EP Patent Application No. 00127179.0 (13 pages).

**Chen, Hao, et al., U.S. Appl. No. 14/693,232 entitled "Thermoplastic Planks and Methods for Making the Same," filed in the U.S. Patent and Trademark Office Apr. 22, 2015.

**Lundblad, Christer, et al., U.S. Appl. No. 14/790,774 entitled "Method to Produce a Thermoplastic Wear Resistant Foil," filed in the U.S Patent and Trademark Office on Jul. 2, 2015.

**Lundblad, Christer, et al., U.S. Appl. No. 14/790,350 entitled "Method to Produce a Thermoplastic Wear Resistant Foil," filed in the U.S. Patent and Trademark Office on Jul. 2, 2015.

**Chen, Hao A , et al., U.S. Appl. No. 14/932,126 entitled "Thermoplastic Planks and Methods for Making the Same," filed in the U.S. Patent and Trademark Office on Nov. 4, 2015.

* cited by examiner

SET OF FLOORBOARDS HAVING A RESILIENT GROOVE

CROSS REFERENCE TO RELATED APPLICATIONS

The present application is a continuation of U.S. application Ser. No. 13/552,357, filed on Jul. 18, 2012, which is a continuation of U.S. application Ser. No. 13/046,011, filed Mar. 11, 2011, which is a continuation of U.S. application Ser. No. 11/649,837, filed on Jan. 5, 2007, and claims the benefit of U.S. Provisional Application No. 60/758,213, filed on Jan. 12, 2006 and the benefit of Swedish Application No. 0600055-8, filed on Jan. 12, 2006. The entire contents of each of U.S. application Ser. No. 13/522,357, U.S. application Ser. No. 13/046,011, U.S. application Ser. No. 11/649,837, U.S. Provisional Application No. 60/758,213 and Swedish Application No. 0600055-8 are hereby incorporated herein by reference.

AREA OF INVENTION

Embodiments of the present invention relate to a set of moisture proof floorboards and flooring with a resilient surface layer comprising a decorative groove and/or a sealing means.

BACKGROUND OF INVENTION

Embodiments of the invention may concern a floorboard comprising a mechanical locking system, formed at least at two opposite edges and a resilient surface layer provided with a decorative groove. The following description of known techniques, problems of known systems and objects and features of embodiments of the invention will above all, as a non-restrictive example, be aimed as the field of the application. It should be emphasized that embodiments of the invention may be used in any floorboard and it could be combined with all types of known locking systems, for example, where the floorboards are intended to be joined using a mechanical locking system connecting the panels in the horizontal and vertical directions on at least two adjacent sides.

It is known that a floorboard with a resilient surface layer can be provided with a decorative joint portion, in the form of a bevel, for example as described in WO 03/012224.

OBJECTS AND SUMMARY

The floorboards with a resilient surface layer with a decorative joint portion known up to now have several disadvantages. It is only possible to provide the edge with a bevel, which is smaller than the thickness of the resilient surface layer. If the bevel is made larger, the bevel extends down to the moisture sensitive core. The resilient layer is normally thin, and therefore it is only possible to produce small bevels, which are barely visible. Another disadvantage is that both joined and adjacent edges of two floorboards have to be provided with the bevel, in order to look attractive and to increase the total width of the decorative joint portion. Known joints between two floorboards with a resilient surface layer also have the problem of penetration of moisture into the joint, which destroys the moisture sensitive core or sub-floor. The problem increases if the floorboards at the joint are provided with bevels, due to accumulating of dirt and moisture at the bottom of the V-shaped grove, formed by the two adjacent bevels, and a remaining thin barrier part of resilient material.

Embodiments of the present invention relate to a moisture proof flooring and a set of moisture proof floorboards with a resilient surface layer comprising a decorative groove, which provides for embodiments offering advantages. A useful area for the floorboards is public flooring, e.g., in stores, restaurants, ships, hotels, airports, or at home in rooms which are heavily exposed to dirt and therefore often cleaned by mopping. Another useful area is wet-rooms. "Moisture proof floorboard" means that the front face of the floorboard is provided with a moisture proof material and that connecting means and edges of the floorboard are configured to obtain a joint between the floorboard and another adjacent floorboard which is moisture proof.

According to a first aspect, embodiments of the invention provide a set of moisture proof floorboards, comprising a front face, a rear face, a core, connecting means arranged at least at two opposite edges for connecting the floorboard with a similar floorboard, a resilient surface layer at the front face, preferably of rubber or plastic. The resilient surface layer comprises a decorative groove at an edge of the floorboard. The bottom of the decorative groove is essentially flat and parallel to the front face.

An advantage of embodiments of the invention is that there is no limitation of the width of the decorative groove. Even a large decorative groove may be watertight and protect the core or the sub-floor. A second advantage is that only half the amount of edges has to be worked, since it is possible to replace two narrow grooves with one wide groove.

Preferably the edge with the decorative groove comprises, in the resilient layer, a sealing means configured to cooperate with another sealing means in the resilient layer at an edge of another adjacent floorboard, to obtain a sealing. In one embodiment, the sealing means comprises a horizontally extending protrusion and the other sealing means comprises a sideways open groove. In the most preferred embodiment one or both of the sealing means are also provided with a sealing agent.

In another preferred embodiment both of the sealing means comprise a sideways open groove provided with a sealing agent.

Preferably, the connecting means comprise a mechanical locking system formed at least at two opposite edges of the floorboard, which facilitates the joining of a similar floorboard. Mechanical locking systems joined by angling are for instance known from WO 94/26999, which is especially advantageous at the long sides of a rectangular floor, and another locking system especially advantageous at the short sides, particularly when combined with an angling locking system like the one described in WO 94/26999, are described in PCT/SE2005/001586, owner Välinge Innovation AB. Other shapes of floorboards are also possible. The above mentioned combination of locking systems makes it possible to join floor panels by several methods preferably with a single action method, where the long edge is installed with angling and the short edge, which is provided with a flexible tongue, with vertical folding. This combination is also very easy to disassemble. Other mechanical locking systems are also known, and possible to use, including, for example, systems joined by Angling-Angling, Angling-Snapping or Snapping-Snapping. Floorboards with a mechanical locking system are generally laid floating, i.e. without gluing, on an existing subfloor.

It is also possible to use a tongue and a groove joint, usually combined with gluing or nailing or other fastening means.

According to an embodiment of the first aspect the wood based core may be made of MDF or HDF, preferably of a thickness of 6-9 mm. The thickness of the resilient surface layer is preferably 1-3 mm.

According to an embodiment, the resilient surface layer comprises three layers, a transparent wear layer at the top, a decorative intermediate layer and reinforcement layer closest to the core. It is also possible to print a pattern directly at the rear side of the transparent wear layer or at the top of the reinforcement layer. Preferably, the decorative groove is only in the transparent layer and optionally colored, but it is also possible to extend the groove down to the decorative layer or the reinforcement layer. Different colors of the layers create a visual effect by extending the groove down to other layers and no coloring may be needed. Another embodiment is a resilient layer comprising only a transparent layer and a reinforcement layer of, for example, a colored plastic or a cork layer. An alternative is that the decorative layer is a wood veneer or a cork layer or that the resilient surface layer has two layers, a transparent wear layer and reinforcement layer of, for example, cork.

According to a second aspect, embodiments of the invention provide a set of moisture proof floorboards, comprising a front face a rear face, a core, connecting means arranged at least at two opposite edges for connecting the floorboard with a similar floorboard, a resilient surface layer at the front face, preferably of rubber or plastic. A moisture proof floorboard being provided at an edge and in the resilient layer with a sealing means configured to cooperate with a another sealing means in the resilient layer at an edge of another adjacent floorboard, to obtain a sealing.

Preferably the sealing means comprises a horizontally extending protrusion and the other sealing means comprises a sideways open groove. In the most preferred embodiment one or both of the sealing means are provided with a sealing agent.

In another preferred embodiment both of the sealing means comprise a sideways open groove provided with a sealing agent.

The sealing means and the sealing agent increase the resistance of moisture and water penetration into the joint and the core and the aim is to completely seal the joint.

According to a second object, embodiments of the invention provide for a flooring comprising at least two of the floorboards above in the first object, joined along adjacent edges, preferably mechanically.

In view of the above, an objective of embodiments of the invention is to solve or at least reduce the problems discussed above.

In particular, an objective of embodiments of this invention is to provide a flooring and floorboard comprising a resilient surface layer with a decorative groove in the resilient surface layer, wherein the groove is clearly visible. Further, the floorboard is moisture proof and preferably shows great acoustic properties.

All references to "a/an/the [element, device, component, means, step, etc.]" are to be interpreted openly as referring to at least one instance of said element, device, component, means, step, etc., unless explicitly stated otherwise.

DETAILED DESCRIPTION OF EMBODIMENTS

As represented in FIGS. 1*b*-4, the first aspect of the invention relates to a set of moisture proof floorboards and flooring, provided with a resilient surface layer with a decorative groove.

Figure 1A:
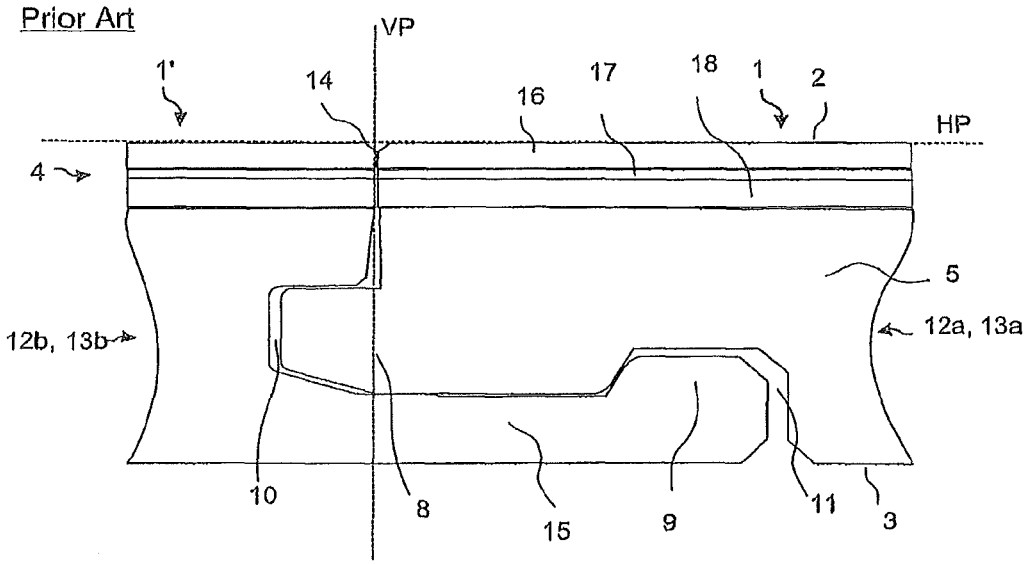
Fig. 1a Prior Art
FIG. 1*a* shows a floorboard with a resilient surface layer and decorative groove known in the art.
Figure 1B:
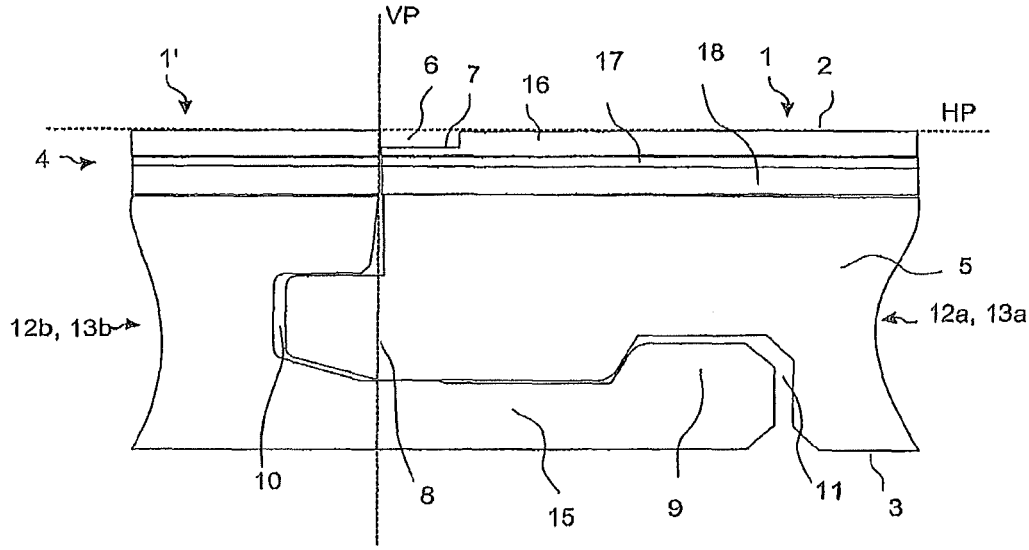
FIG. 1*b* shows a floorboard according to an embodiment of the invention.

FIG. 1*a* show floorboards with decorative joint portions known in the art and described in WO 03/012224. The floorboard 1 comprises a front face 2 and a rear face 3 extending in the direction of the horizontal plane HP, a wood-based core 5 and a resilient surface layer 4 at the front face. The resilient surface layer 4 comprises three different surface layers having different functions. The upper most layer is a transparent, hard and durable wear layer 16 of plastic material, the intermediate layer is a decorative layer 17 of plastic film and the lowest layer is a reinforcement layer 18 which is made of an elastic material and which can be both moisture-proof and sound-absorbing. The decorative layer 17 of plastic film can be replaced with decorative patterns, which are printed directly on the underside of the transparent wear layer 16 or on the upper side of the elastic reinforcement layer 18. The floorboard is provided with a mechanical locking system for locking the floorboards horizontally and vertically at its long and short edges (12*a*, 13*a*, 12*b*, 13*b*) through angling and/or snapping.

According to a first aspect of the invention, as represented in FIG. 1*b*-4*c*, a floorboard 1 is to be joined with a similar floorboard 1' at adjacent joint edges at a joint plane extending in the vertical plane VP, comprising a front face 2 and a rear face 3 extending in the horizontal plane HP, a core 5, a connecting means arranged at least at two opposite edges for connecting the floorboard with a similar floorboard 1' in a vertical and/or horizontal direction and a resilient surface layer 4, characterized in that at least one edge of the floorboard 1 comprising a decorative groove 6 in the resilient surface layer 4 with a bottom 7 which is essentially parallel to the front face 2. If the floorboard is rectangular, preferably only one of the long edges is provided with the decorative groove; certainly it is also possible to provide one of the long and one of the short edges with the groove 7. Other shapes of the board are also possible, e.g. 3, 5, 6, 7 and 8 edges. The resilient surface layer comprises preferably a transparent wear layer 16 at the top, preferably of a plastic material, an intermediate decorative layer 17 and an elastic reinforcement layer 18 closest to the core 5. The decorative layer 17, preferably of a plastic film can be replaced with decorative patterns, which are printed directly on the underside of the transparent wear layer 16 or on the upper side of the elastic reinforcement layer 18. An alternative is that the decorative layer is a wood veneer or cork layer. According to the embodiment represented in FIG. 1*b*, the groove 7 is only in the transparent layer and optionally the groove is colored.

Preferably the connecting means is a mechanical locking system formed at least at two opposite edges 12*a*, 13*a*, 12*b*, 13*b*. The shown mechanical locking system comprising a locking strip 15 with a locking element 9, a tongue 8 and a tongue groove 10. Other known mechanical locking systems for floorboards are also possible to use such as the tongue lock in FIG. 4*a-c* or the flexible tongue described in described in PCT/SE2005/001586. The tongue may also be replaced by a displaceable tongue 8' arranged in a displacement grove 54, as shown in FIGS. 5*b* to 6*c*, of the type disclosed in PCT/SE2005/001586 or PCT/SE2006/001218.

There are many alternatives for the number of layers in the resilient layer, the material of the layers and into which layer the groove extends. Some of the alternatives are represented in FIG. 1*b*-2*d*.

Figure 2A:
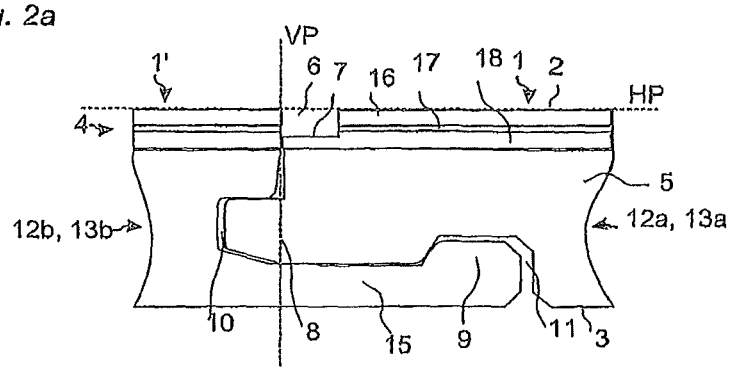
FIGS. 2*a-d* show alternative embodiments of the invention.

The resilient surface layer 4, illustrated in FIG. 2*a*, comprising a transparent surface layer 16, an intermediate decorative layer 17 and a reinforcement layer 18 closest to the core. The groove 6 extends down to the reinforcement layer and is preferably colored. If one of the layers in the resilient layer, represented in FIG. 1*b-bd* is of a non-water proof or moisture sensitive material, it is preferred that the groove does not extend into this layer.

Figure 2B:
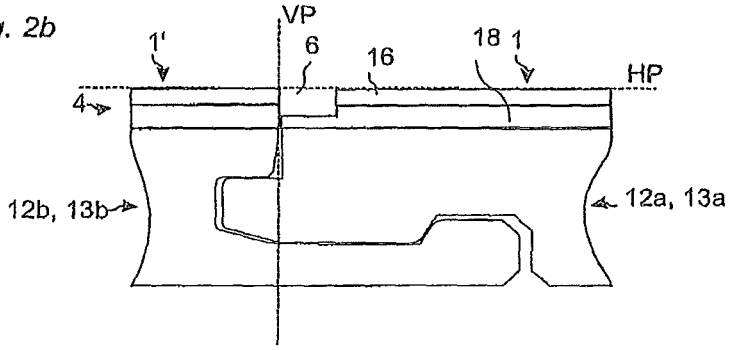

The resilient surface layer 4, illustrated in FIG. 2*b*, is substantially a transparent surface layer 16 and a reinforcement layer closest to the core 18. The groove 6 extends down to the reinforcement layer, preferably of plastic and is preferably colored.

Figure 2C:
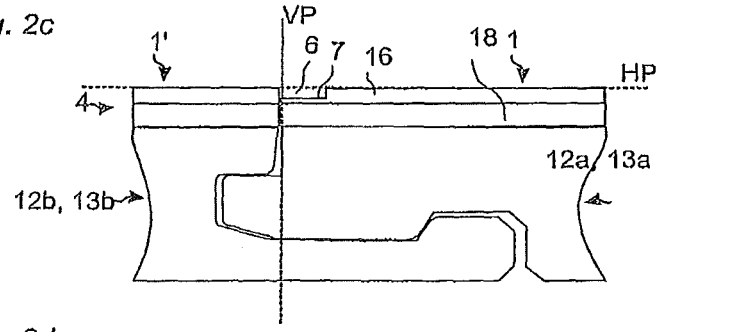

The resilient surface layer 4 illustrated in FIG. 2*c*, is substantially a transparent surface layer 16 and a reinforcement layer closest to the core 18. The groove 6 is only in the transparent layer and is preferably colored. The reinforcement layer is preferably of a colored plastic or a cork layer.

Figure 2D:
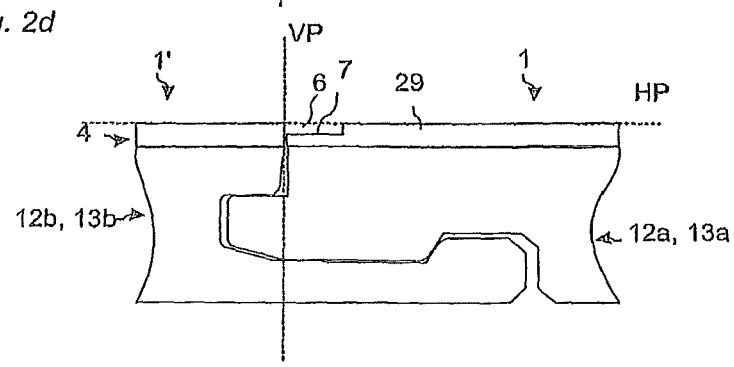

The resilient surface layer 4 in FIG. 2*d*, is substantially only one layer. The groove is preferably colored.

Figure 4A:
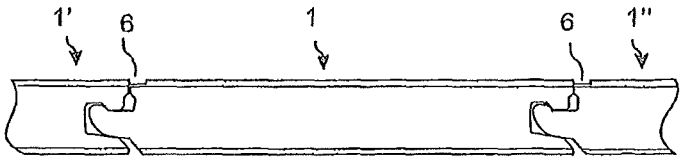
FIGS. 4*a-c* show a floorboard and joined floorboards in different views according to an embodiment of the invention.
Figure 4B:
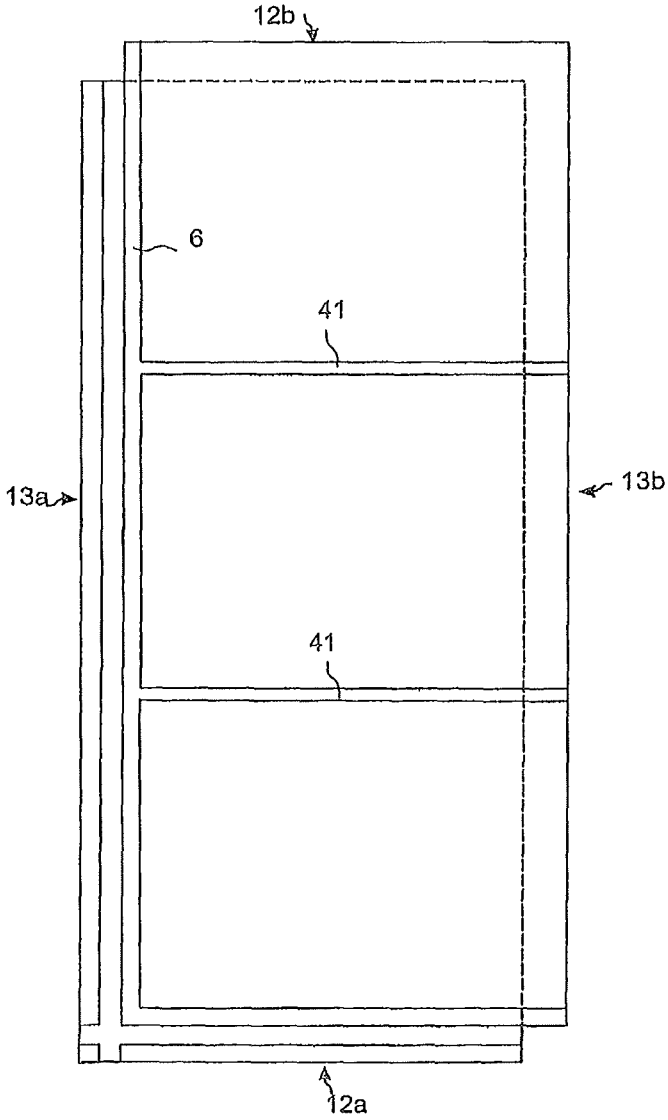
Figure 4C:
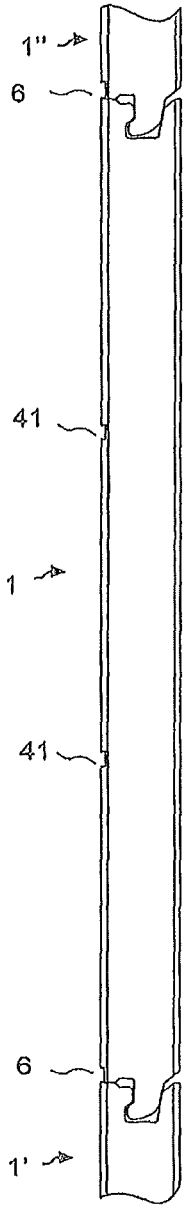

In FIG. 4*b* an embodiment of the invention is represented, comprising a rectangular floorboard 1 with a mechanical locking system at long 13*a*, 13*b* and short edges 12*a*, 12*b* and a decorative groove 6 along only one of the long edges and along only one of the short edges. Additional grooves 41 in the resilient surface layer, between the short edges, are provided. FIG. 4*a* is a cross section of the floorboard in FIG. 6*b*, perpendicular to the long edges, joined to similar floorboards 1' and 1". FIG. 4*c* is a cross section of the floorboard in FIG. 4*b*, perpendicular to the short edges, joined to similar floorboards 1' and 1".

The wood-based core material is preferably a particle, MDF, HDF or plywood board.

As non-limiting example, materials that can be used in a resilient surface layer are acrylic plastic-based materials, elastomers of synthetic rubber, urethane rubber, silicone rubber or the like, polyurethane-based hot-melt adhesive, PVC or polyethylene.

The decorative groove may be made by chemical or mechanical working, preferably cutting or grinding. It is also possible to color the groove. If grinding is used it is possible to make a very shallow groove or even just change the roughness and the brightness of the surface. The grinding method is applicable also to a laminate flooring with a surface layer of resin-impregnated sheets. Another technique is to cut off a part of the resilient surface layer, or cut it to the desirable shape before attaching it to the core, and replace it with another resilient layer of different color or structure.

A second aspect of the invention, as illustrated in FIG. 5*a*-6*c*, is a set of essentially identical moisture proof floorboards 1 each comprising a sealing means at an edge. Each floorboard comprises a front face and a rear face extending in the horizontal plane HP, a core, a connecting means 8, 9, 10, 11, 15, 8', 54 arranged at least at two opposite edges for connecting a floorboard with a another floorboard 1' in a vertical and/or horizontal direction and a resilient surface layer 4. A moisture proof floorboard comprising, at an edge and in the resilient layer 4, a sealing means 51 configured to cooperate with another sealing means 52 in the resilient layer at an edge of another adjacent floorboard, to obtain a sealing.

Figure 5A:
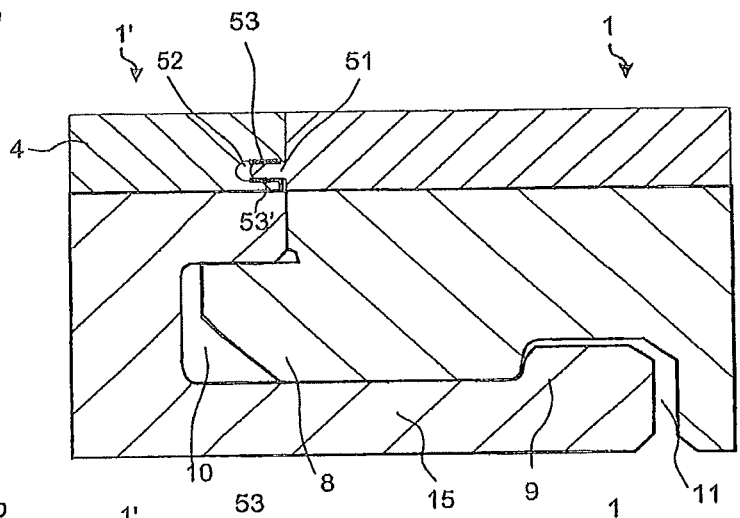
FIGS. 5*a*, 5*c* and 6*a*-6*c* show joined floorboards according to embodiments of the second aspect of the invention.
Figure 5B:
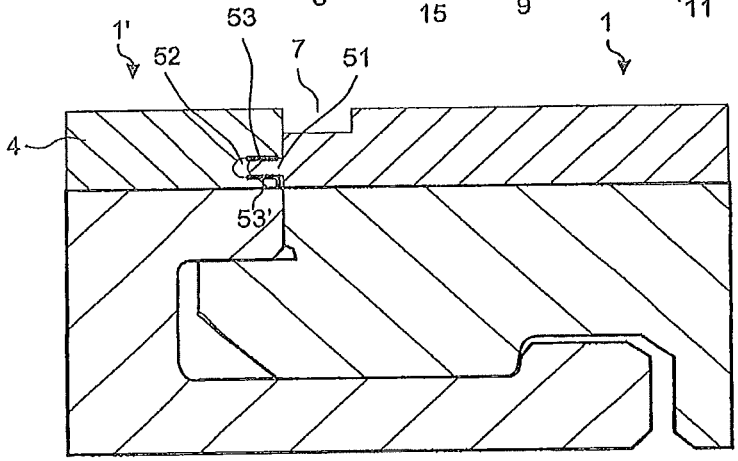
FIG. 5*b* shows an embodiment of a floorboard, according to the first aspect provided with a sealing means according to the second aspect.

The sealing means may comprise a horizontally extending protrusion and the other sealing means may comprise a sideways open groove, as shown in FIG. 5*a*. In the most preferred embodiment one or both of the sealing means are provided with a sealing agent 53.

Figure 6A:
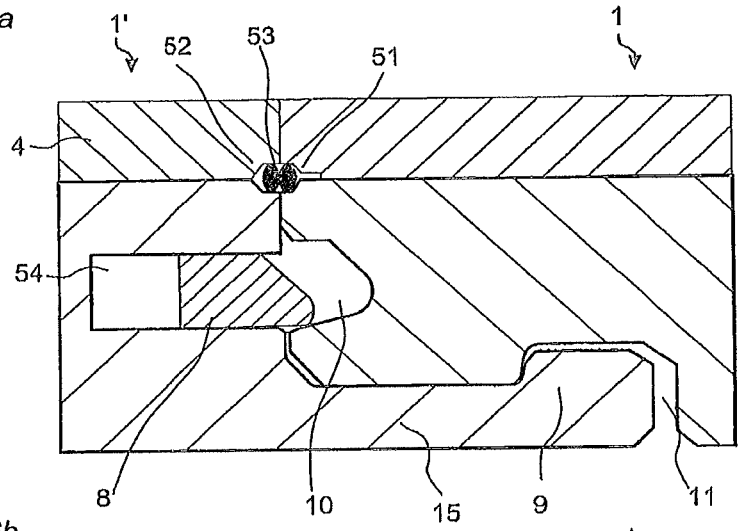

In another embodiment, shown in FIG. 6*a*, both the sealing means 51, 52 comprise a sideways open groove provided with a sealing agent 53.

Figure 5C:
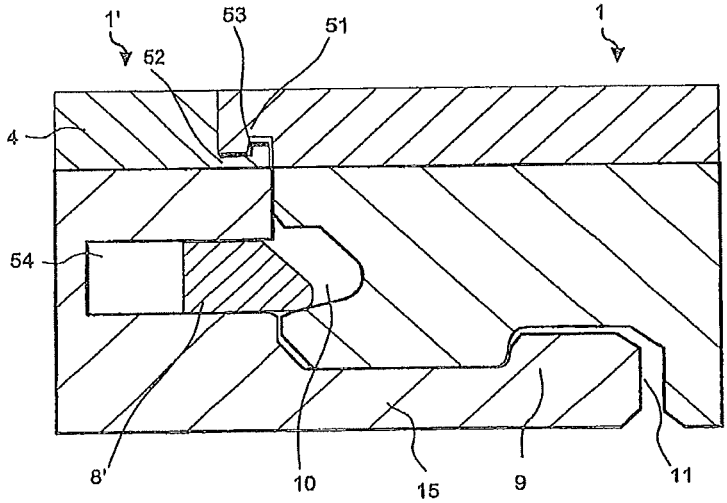

In FIG. 5*c* an embodiment of the sealing means is illustrated comprising overlapping edges, preferably provided with a hook shaped connection 51, 52. A sealing agent 53 may also be provided.

The sealing agent may comprise wax, grease, oil or bitumen. A preferred sealing agent comprises a mix of paraffin wax and paraffin oil. Another example is a micro wax and a natural or synthetic rubber strip.

Figure 6B:
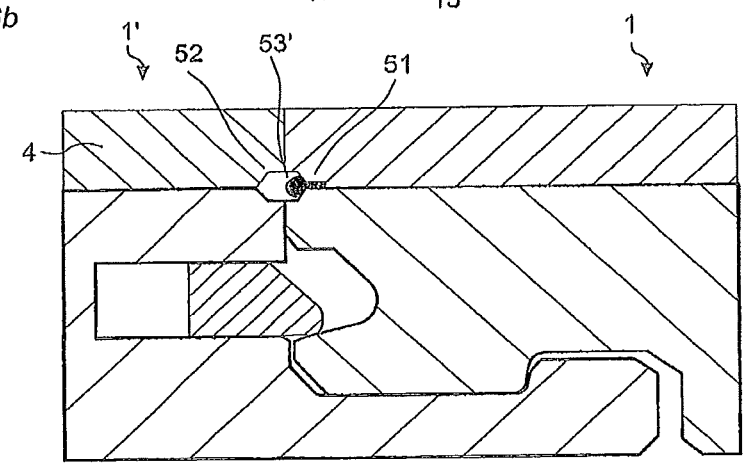
Figure 6C:
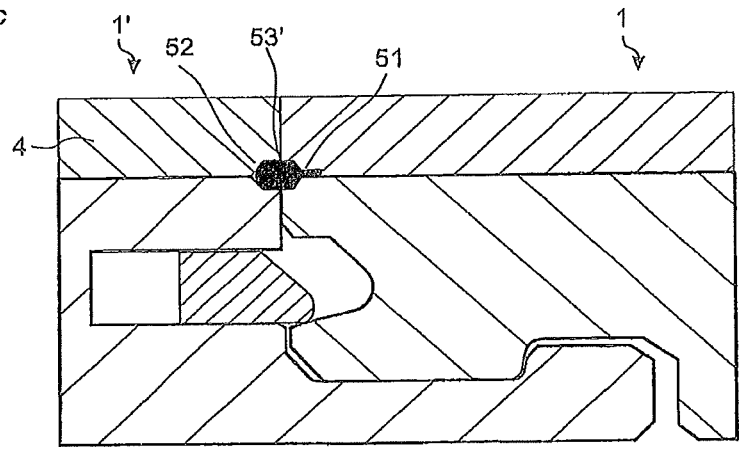

In FIG. 6*b* an embodiment of the sealing means is illustrated comprising an expandable sealing agent 53', arranged at a sideways open groove 51 in the resilient layer 4. The sealing agent is configured to expand into a sideways open groove 52 in the resilient layer of an adjacent floor panel, as illustrated in FIG. 6*c*, after that the two panels are connected to each other by the connecting means. An example of an expandable sealing agent 53' is a strip, preferably of polyurethane, provided with tape, which is removed just before the connection of the two adjacent floorboards. Other examples are materials, which expand when exposed to moisture.

The first aspect of the invention, comprising a decorative groove 7, may be combined with the second aspect, comprising sealing means 51, 52, as illustrated in 5*b*.

Figure 3:
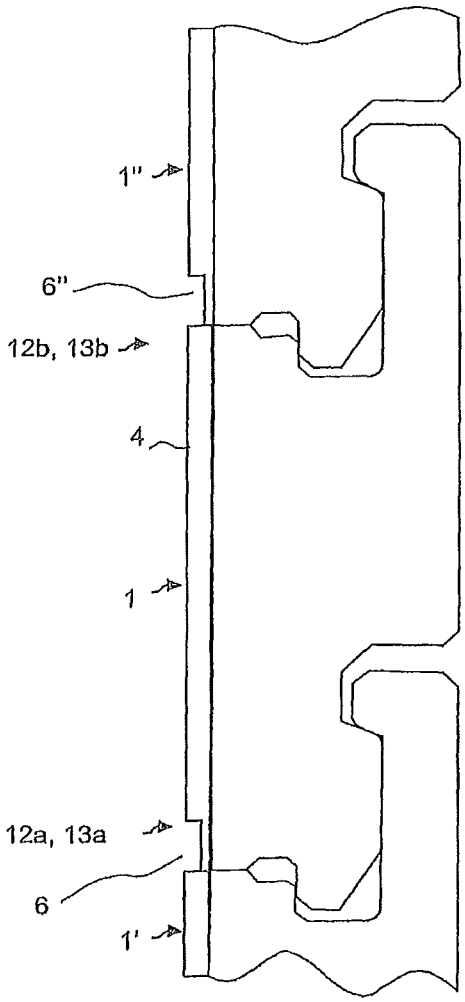
FIG. 3 shows three joined floorboards according to an embodiment of the invention.

A second object of the invention, represented by FIGS. 3 and 4, is a flooring comprising a set of the floorboards 1, 1', according to the first and/or second aspect, joined along adjacent edges, preferably mechanically.

In the most preferred embodiment, only one of the edges 12*a*, 13*a*, 12*b*, 13*b* of the two joined and adjacent edges is provided with the decorative groove.

Embodiments of the invention have mainly been described above with reference to a few embodiments. However, as is readily appreciated by a person skilled in the art, other embodiments than the ones disclosed above are equally possible within the scope of the invention, as defined by the appended patent claims.

Generally, all terms used in the claims are to be interpreted according to their ordinary meaning in the technical field, unless explicitly defined otherwise herein.

The invention claimed is:

1. A set of essentially identical moisture proof floorboards, each floorboard comprising a front face and a rear face extending in a horizontal plane, a core, a connector arranged at least at two opposite edges for connecting one of the floorboards with another floorboard in a vertical or horizontal direction, and a resilient surface layer, wherein at least one edge of each of the floorboards comprises a decorative groove in the resilient surface layer, wherein the decorative groove has a roughness and a brightness that differs from the remaining front face, wherein the resilient surface layer comprises a transparent wear layer of a moisture proof material, and wherein a bottom of the decorative groove is in the transparent wear layer.

2. The set of essentially identical moisture proof floorboards as claimed in claim 1, wherein the edge with the decorative groove comprises a sealing arrangement configured to cooperate with another sealing arrangement in the resilient layer at an edge of another adjacent floorboard to obtain a sealing.

3. The set of essentially identical moisture proof floorboards as claimed in claim 2, wherein one of the sealing arrangements is a horizontally extending protrusion and the other sealing arrangement is a sideways open groove.

4. The set of essentially identical moisture proof floorboards as claimed in claim 3, wherein one or both of the sealing arrangements comprises a sealing agent.

5. The set of essentially identical moisture proof floorboards as claimed in claim 2, wherein both of the sealing arrangements are a sideways open groove comprising a sealing agent.

6. The set of essentially identical moisture proof floorboards as claimed in claim 4, wherein the sealing agent comprises paraffin wax or paraffin oil.

7. The set of essentially identical moisture proof floorboards as claimed in claim 5, wherein the sealing agent comprises paraffin wax or paraffin oil.

8. The set of essentially identical moisture proof floorboards as claimed in claim 1, wherein a width of the decorative groove is larger than a thickness of the resilient surface layer.

9. The set of essentially identical moisture proof floorboards as claimed in claim 1, wherein a width of the decorative groove is at least twice as large as a thickness of the resilient surface layer.

10. The set of essentially identical moisture proof floorboards as claimed in claim 1, wherein each floorboard is provided with the decorative groove only at one of the two opposite edges.

11. The set of essentially identical moisture proof floorboards as claimed in claim 10, wherein each floorboard is quadrilateral and has a decorative joint portion only at one edge.

12. The set of essentially identical moisture proof floorboards as claimed in claim 10, wherein each floorboard is quadrilateral and has a decorative joint portion only at two adjacent edges.

13. The set of essentially identical moisture proof floorboards as claimed in claim 1, wherein each floorboard comprises a core of a wood-based material.

14. The set of essentially identical moisture proof floorboards as claimed in claim 13, wherein the core comprises HDF, MDF, particleboard or plywood.

15. The set of essentially identical moisture proof floorboards as claimed in claim 1, wherein the connector is a mechanical locking system.

16. The set of essentially identical moisture proof floorboards as claimed in claim 15, wherein the mechanical locking system is formed in the edge of each floorboard.

17. The set of essentially identical moisture proof floorboards as claimed in claim 1, wherein the resilient surface layer comprises a plastic material.

18. The set of essentially identical moisture proof floorboards as claimed in claim 17, wherein the plastic is PVC or polyethylene.

19. The set of essentially identical moisture proof floorboards as claimed in claim 1, wherein the resilient surface layer comprises a decorative layer.

20. The set of essentially identical moisture proof floorboards as claimed in claim 19, wherein the decorative layer is a plastic film, a wood veneer, a cork layer or a print.

21. The set of essentially identical moisture proof floorboards as claimed in claim 1, wherein the resilient surface layer comprises a reinforcement layer, wherein the reinforcement layer is the layer of the resilient surface layer positioned closest to the core of each floorboard.

22. The set of essentially identical moisture proof floorboards as claimed in claim 1, wherein the resilient surface layer comprises a decorative layer and a reinforcement layer, wherein the reinforcement layer is the layer of the resilient surface layer positioned closest to the core of each floorboard.

23. The set of essentially identical moisture proof floorboards as claimed in claim 1, wherein the resilient surface layer comprises substantially only one layer of a moisture proof material.

24. The set of essentially identical moisture proof floorboards as claimed in claim 1, wherein the decorative groove is at an edge of the floorboards which comprises the connector.

* * * * *